US009774071B2

(12) United States Patent
Lee et al.

(10) Patent No.: US 9,774,071 B2
(45) Date of Patent: Sep. 26, 2017

(54) ANTENNA STRUCTURE

(71) Applicant: Chiun Mai Communication Systems, Inc., New Taipei (TW)

(72) Inventors: Yi-Chieh Lee, New Taipei (TW); Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 225 days.

(21) Appl. No.: 14/024,842

(22) Filed: Sep. 12, 2013

(65) Prior Publication Data

US 2014/0320349 A1 Oct. 30, 2014

(30) Foreign Application Priority Data

Apr. 30, 2013 (TW) ..... 102115373 A

(51) Int. Cl.
*H01Q 1/24* (2006.01)
*H01Q 9/42* (2006.01)
*H01Q 5/371* (2015.01)
*H01Q 5/392* (2015.01)

(52) U.S. Cl.
CPC ..... *H01Q 1/243* (2013.01); *H01Q 5/371* (2015.01); *H01Q 5/392* (2015.01); *H01Q 9/42* (2013.01)

(58) Field of Classification Search
CPC ..... H01Q 5/00; H01Q 1/243
USPC ..... 343/700
See application file for complete search history.

(56) References Cited

U.S. PATENT DOCUMENTS 7,119,748 B2 * 10/2006 Autti ..... H01Q 1/243 343/700 MS
7,136,019 B2 * 11/2006 Mikkola ..... H01Q 1/243 343/700 MS
8,373,603 B2 * 2/2013 Montgomery ..... H01Q 7/00 343/700 MS
2006/0262016 A1 * 11/2006 Hung ..... H01Q 9/42 343/700 MS
2008/0316121 A1 12/2008 Hobson et al.
2010/0277390 A1 * 11/2010 Lee ..... H01Q 9/42 343/846
2011/0260939 A1 * 10/2011 Korva ..... H01Q 1/243 343/725
2012/0176273 A1 * 7/2012 Yu ..... H01Q 1/243 343/700 MS

* cited by examiner

*Primary Examiner* — Dameon E Levi
*Assistant Examiner* — Walter Davis
(74) *Attorney, Agent, or Firm* — Steven Reiss

(57) ABSTRACT

An antenna structure includes a feed portion, a ground portion, a primary antenna, a secondary antenna, and a metal portion connected to the ground portion. The primary antenna includes first and second radiating portions. The first radiating portion and the second radiating portion are both connected to the feed portion and are positioned at opposite sides of the feed portion. The secondary antenna includes third and fourth radiating portions. The third radiating portion and the fourth radiating portion are connected to the ground portion and positioned at two sides of the ground portion.

13 Claims, 3 Drawing Sheets

ANTENNA STRUCTURE

BACKGROUND

1. Technical Field

The disclosure generally relates to antenna structures and particularly to an antenna structure having a wider bandwidth.

2. Description of Related Art

To communicate in multi-band communication systems, a bandwidth of an antenna of a wireless communication device such as a mobile phone needs to be wide enough to cover frequency bands of the multi-band communication systems. In addition, because of the miniaturization of the wireless communication device, space available for the antenna is reduced and limited. Therefore, it is a challenge to design the antenna to have the wider bandwidth within a smaller space.

Therefore, there is room for improvement within the art.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the disclosure.

DETAILED DESCRIPTION

Figure 1:
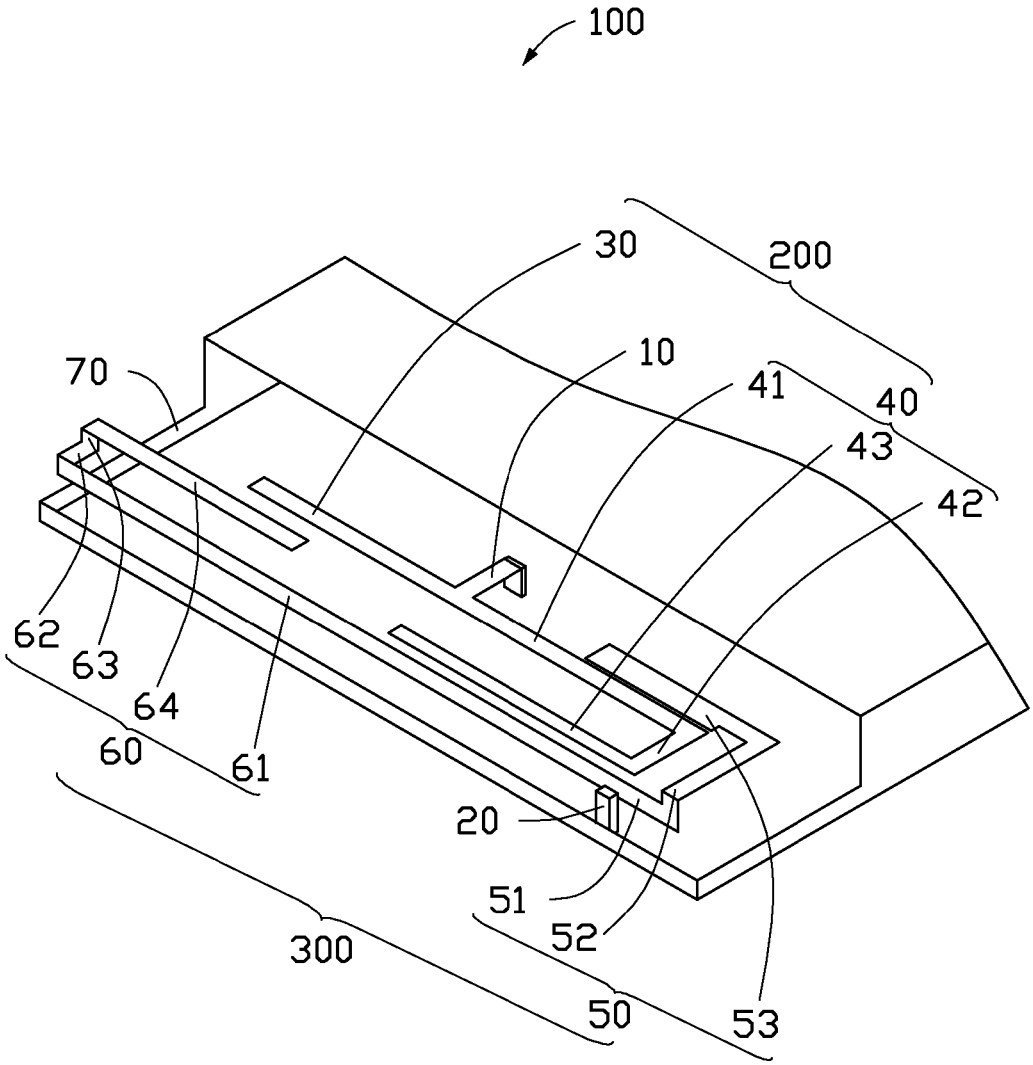
FIG. 1 is a schematic view of an antenna structure, according to an exemplary embodiment.

FIG. 1 is a schematic view of an antenna structure 100, according to an exemplary embodiment. The antenna structure 100 is for use in a wireless communication device (not shown), such as a mobile phone, a personal digital assistant, or a laptop computer.

The antenna structure 100 includes a feed portion 10, a ground portion 20, a primary antenna 200, a secondary antenna 300, and a metal portion 70. The primary antenna 200 is electronically connected to the feed portion 10. The secondary antenna 300 and the metal portion 70 are both electronically connected to the ground portion 20.

The feed portion 10 is electronically connected to a contact of a printed circuit board of the wireless communication device (not shown), which feeds current for the antenna structure 100. In this embodiment, the feed portion 10 is substantially L-shaped and has one end positioned at a plane perpendicular to a plane of the printed circuit board and connected to the feed contact, and another end positioned at a plane parallel to the plane of the printed circuit board and connected to the primary antenna 200.

The ground portion 20 is electronically connected between the secondary antenna 300 and the metal portion 70. The ground portion 20 is further electronically connected to a ground contact of the wireless communication device (not shown), which provides ground for antenna structure 100.

The primary antenna 200 is a monopole antenna. The primary antenna 200 is positioned at a plane parallel to the plane of the printed circuit board. The primary antenna 200 includes a first radiating portion 30 and a second radiating portion 40. The first radiating portion 30 and the second radiating portion 40 are both connected to the feed portion 10 and positioned at opposite sides of the feed portion 10.

The first radiating portion 30 is substantially strip-shaped and perpendicularly connected to a side of the feed portion 10 parallel to the printed circuit board. The second radiating portion 40 and the first radiating portion 30 are coplanar. The second radiating portion 40 is substantially U-shaped and includes a first extending section 41, a second extending section 42, and a third extending section 43 connected in that order. The first extending section 41 is substantially strip-shaped. The first extending section 41 is perpendicularly connected to another side of the feed portion 10 opposite to the first radiating portion 30 and is collinear with the first radiating portion 30. The second extending section 42 has one end perpendicularly connected to an end of the first extending section 41 away from the first radiating portion 30 and another end perpendicularly connected to the third extending section 43.

The secondary antenna 300 is a microstrip line and includes a third radiating portion 50 and a fourth radiating portion 60. The third radiating portion 50 and the fourth radiating portion 60 are both connected to the ground portion 20 and positioned at opposite sides of the ground portion 20. That is, the third radiating portion 50 is connected to a first side of the ground portion 20 and extends in a first direction away from the ground portion 20. The fourth radiating portion 60 is connected to a second side of the ground portion 20 and extends in a second direction, opposite to the first direction, away from the ground portion 20.

The third radiating portion 50 surrounds a periphery edge of the second radiating portion 40. The third portion 50 includes a first connecting section 51, a second connecting section 52, and a third connecting section 53 connected in that order. The first connecting section 51 is positioned at a plane perpendicular to a plane of the primary antenna 200 and a plane of the printed circuit board. The first connecting section 51 is substantially L-shaped. The first connecting section 51 has one end perpendicularly connected to the ground portion 20 and another end extending towards the second radiating portion 40. The second extending section 52, the third extending section 53, and the primary antenna 200 are coplanar. The second extending section 52 is substantially L-shaped. One end of the second extending section 52 is perpendicularly connected to a distal end of the first extending section 52 and parallel to the second extending section 42. Another end of the second connecting section 52 is parallel to the first extending section 41 and extends towards the first radiating portion 30 until a distal of the second connecting section 52 is level with a peripheral edge of the second extending section 42. A width of the second connecting section 52 is less than a width of the third connecting section 53. The third connecting section 53 is connected to a distal end of the second connecting section 52 and parallel to the first extending section 41.

The fourth radiating portion 60 is connected to a side of the ground portion 20 opposite to the third radiating portion 50. The fourth radiating portion 60 includes a first combining section 61, a second combining section 62, a third combining section 63, and a fourth combining section 64 connected in that order. The first combining section 61 is strip-shaped. The first combining section 61 is connected to a side of the ground portion 20 opposite to the first connecting section 51 and is collinear with a portion of first connecting section 51 close to the ground portion 20. The second combining section 62 and the third combining section 63 are positioned at a plane perpendicular to a plane of the first combining section 61 and a plane of the first radiating portion 30. The second combining section 62 is perpendicularly connected between the first combining section 61 and the third combining section 63. The fourth combining section 64 is positioned at the plane of the first radiating portion 30. The fourth combining section 64 is perpendicularly connected to a distal end of the third combining section 63 and is parallel to the first radiating portion 30. The fourth combining section 64 extends towards the second radiating portion 40 and is positioned between first extending section 41 and the third extending section 43. In this embodiment, a length of the fourth combining section 64 is less than a length of the third extending section 43.

The metal portion 70 may be a portion of a metal housing of the wireless communication device, e.g., a metal frame of the wireless communication device. The metal portion 70 surrounds the printed circuit board of the wireless communication device and connected to the ground contact of the printed circuit board. In this embodiment, the metal portion 70 is connected to an end of the ground portion 20 opposite to the secondary antenna 300 and spaced from the primary antenna 200 and the secondary antenna 300.

When the antenna structure 100 is used, current is fed from the feed portion 10, the primary antenna 200 and the secondary antenna 300 cooperatively create a resonance. Then, the current respectively flows through the first radiating portion 30, the second radiating portion 40, the third radiating portion 50, the fourth radiating portion 60, and the metal portion 70 to form a plurality of current paths having different electrical lengths so as to achieve multiple frequency bands.

In detail, when a maximum current flows through the first radiating portion 30, the first radiating portion 30 and the fourth radiating portion 60 cooperatively create a resonance, thereby rendering the antenna structure 100 receptive to a first high frequency band having a central frequency at 2500 MHz. In this way, the antenna structure 100 can work at a frequency band of LTE.

When the maximum current flows through the second radiating portion 40, the second radiating portion 40 resonates at a second high frequency band having a central frequency at 1800 MHz. In this way, the antenna structure 100 can work at a frequency band of DCS/PCSLTE.

When the maximum current flows through the third radiating portion 50, the third radiating portion 50 resonates at a third high frequency band having a central frequency at 2000 MHz. In this way, the antenna structure 100 can work at a frequency band of WCDMA.

When the maximum current flows through the third radiating portion 50, the fourth radiating portion 60, and the metal portion 70, the third radiating portion 50, the fourth radiating portion 60, and the metal portion 70 cooperatively resonate at a low frequency band having a central frequency at 800 MHz. In this way, the antenna structure 100 can work at a frequency band of GSM/EGSM.

Figure 2:
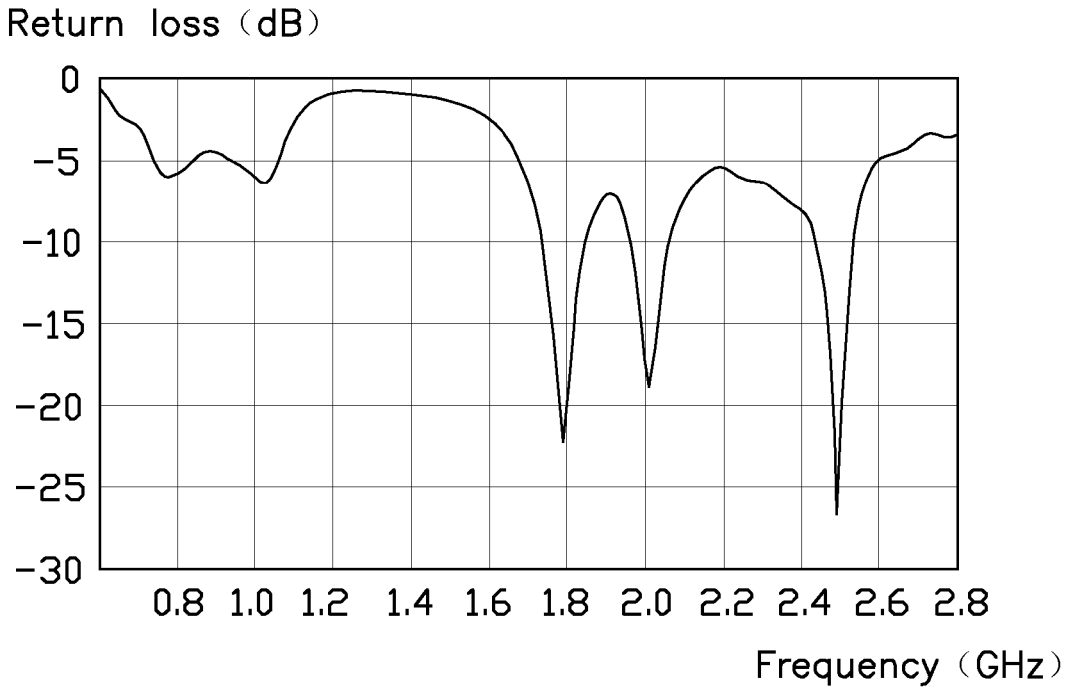
FIG. 2 is a diagram showing return loss measurements of the antenna structure shown in FIG. 1.

FIG. 2 is a measurement diagram of return loss (RL) of the antenna structure 100. When the antenna structure 100 receives/sends wireless signals at frequencies of about 800 MHz, 1800 MHz, 2000 MHz, and 2500 MHz, the RL of the antenna structure 100 satisfies communication standards.

Figure 3:
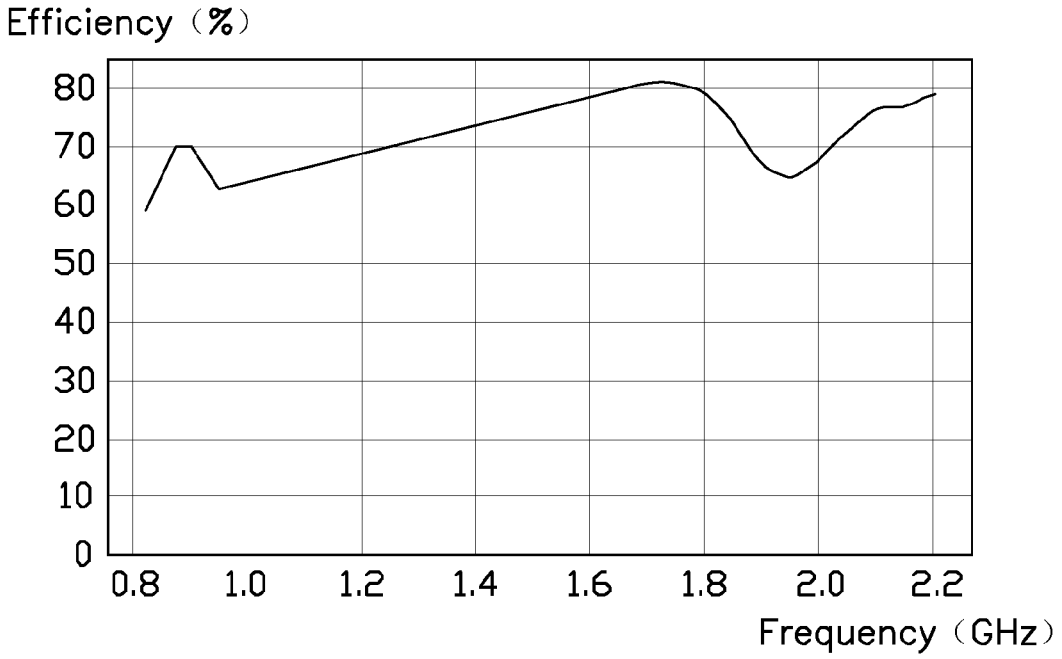
FIG. 3 is a diagram showing radiating efficiency measurements of the antenna structure shown in FIG. 1.

FIG. 3 is a measurement diagram of radiating efficiency of the antenna structure 100. When the antenna structure 100 works at a low frequency band (800 MHz-1000 MHz), radiating efficiencies of the antenna structure 100 are above 60%. When the antenna structure 100 works at a high frequency band (1700 MHz-22000 MHz), radiating efficiencies of the antenna structure 100 are above 70%, which are both acceptable and satisfy radiation requirements.

The antenna structure 100 includes a plurality of radiating portions, and the metal portion 70 and the plurality of radiating portions can cooperatively create a plurality of resonance modes so that a bandwidth of the antenna structure 100 is widened. In addition, the metal portion 70 is a portion of a housing of the wireless communication device so that the antenna structure 100 occupies less space and also costs less.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. An antenna structure, comprising:

a feed portion;

a ground portion;

a primary antenna comprising a first radiating portion and a second radiating portion, the first radiating portion and the second radiating portion both connected to the feed portion and positioned at two sides of the feed portion, wherein the first radiating portion and the second radiating portion are coplanar, the first radiating portion is strip-shaped and perpendicularly connected to a side of the feed portion, the second radiating portion is U-shaped and comprises a first extending section, a second extending section, and a third extending section connected in that order, the first extending section is perpendicularly connected to another side of the feed portion opposite to the first radiating portion and is collinear with the first radiating portion, the second extending section is perpendicularly connected to one end of the first extending section away from the first radiating portion and extends away from the feed portion; the third extending section is perpendicularly connected to one end of the second extending section away from the first extending section and extends towards the first radiating portion to be parallel to the first extending section;

a secondary antenna spaced from the primary antenna and comprising a third radiating portion and a fourth radiating portion, the third radiating portion and the fourth radiating portion both connected to the ground portion and positioned at opposite sides of the ground portion; wherein the third radiating portion comprises a first connecting section, the first connecting section is substantially L-shaped and is positioned at a plane perpendicular to a plane of the primary antenna, the fourth radiating portion comprises a first combining section, a second combining section, a third combining section, and a fourth combining section connected in that order, the second combining section and the third combining section are positioned at a plane perpendicular to a plane of the first combining section, the fourth combining section is positioned at a plane both perpendicular to a plane of the first combining section and the plane of the second combining section, the first combining section is connected to the ground portion and is collinear with a portion of the first connecting section close to the ground portion; the second combining section is perpendicularly connected between the first combining section and the third combining section; the fourth combining section is perpendicularly connected to a distal end of the third combining section and is parallel to the first radiating portion, the fourth combining section extends towards the second radiating portion and is positioned between first extending section and the third extending section; and a metal portion connected to the ground portion and configured for current from the antenna structure flowing through the metal portion to the ground.

2. The antenna structure of claim 1, wherein when a current flows through the first radiating portion, the first radiating portion and the fourth radiating portion cooperatively resonate at a first high frequency band; when the current flows through the second radiating portion, the second radiating portion resonates at a second high frequency band; when the current flows through the third radiating portion, the third radiating portion resonates at a third high frequency band; when the current flows through the third radiating portion, the fourth radiating portion, and the metal portion, the third radiating portion, the fourth radiating portion, and the metal portion cooperatively resonate at a low frequency band.

3. The antenna structure of claim 1, wherein the primary antenna is a monopole antenna, the secondary antenna is a microstrip line.

4. The antenna structure of claim 1, wherein the third radiating portion surrounds a periphery edge of the second radiating portion.

5. The antenna structure of claim 1, wherein the third radiating portion further comprises a second connecting section and a third connecting section, the second connecting section and the third connecting section are coplanar with the primary antenna; one end of the second connecting section is perpendicularly connected to a distal end of the first connecting section and parallel to the second extending section, another end of the second connecting section is parallel to the first extending section and extends towards the first radiating portion, the third connecting section is connected to a distal end of the second connecting section and parallel to the first extending section.

6. The antenna structure of claim 2, wherein a central frequency of the first high frequency band is about 2500 MHz, a central frequency of the second high frequency band is about 1800 MHz, a central frequency of the third high frequency band is about 2000 MHz, and a central frequency of the low frequency band is about 800 MHz.

7. An antenna structure, comprising:

a feed portion;

a ground portion;

a primary antenna connected to the feed portion and comprising a first radiating portion and a second radiating portion, wherein the first radiating portion and the second radiating portion are coplanar, the first radiating portion is strip-shaped and perpendicularly connected to a side of the feed portion, the second radiating portion is U-shaped and comprises a first extending section, a second extending section, and a third extending section connected in that order, the first extending section is perpendicularly connected to another side of the feed portion opposite to the first radiating portion and is collinear with the first radiating portion, the second extending section is perpendicularly connected to one end of the first extending section away from the first radiating portion and extends away from the feed portion; the third extending section is perpendicularly connected to one end of the second extending section away from the first extending section and extends towards the first radiating portion to be parallel to the first extending section;

a secondary antenna spaced from the primary antenna and connected to the ground portion, wherein the secondary antenna comprises a third radiating portion and a fourth radiating portion; wherein the third radiating portion comprises a first connecting section, the first connecting section is substantially L-shaped and is positioned at a plane perpendicular to a plane of the primary antenna, the fourth radiating portion comprises a first combining section, a second combining section, a third combining section, and a fourth combining section connected in that order, the second combining section and the third combining section are positioned at a plane perpendicular to a plane of the first combining section, the fourth combining section is positioned at a plane both perpendicular to a plane of the first combining section and the plane of the second combining section, the first combining section is connected to the ground portion and is collinear with a portion of the first connecting section close to the ground portion; the second combining section is perpendicularly connected between the first combining section and the third combining section; the fourth combining section is perpendicularly connected to a distal end of the third combining section and is parallel to the first radiating portion, the fourth combining section extends towards the second radiating portion and is positioned between first extending section and the third extending section; and a metal portion, the metal portion being a portion of a metal housing of a wireless communication device and connected to the ground portion; wherein the primary antenna, the secondary antenna, and the metal portion cooperatively form a plurality of current paths having different electrical lengths so as to achieve multiple frequency bands.

8. The antenna structure of claim 7, wherein the third radiating portion and the fourth radiating portion are both connected to the ground portion and positioned at two sides of the ground portion.

9. The antenna structure of claim 7, wherein when a current flows through the first radiating portion, the first radiating portion and the fourth radiating portion cooperatively resonate at a first high frequency band; when the current flows through the second radiating portion, the second radiating portion resonates at a second high frequency band; when the current flows through the third radiating portion, the third radiating portion resonates at a third high frequency band; when the current flows through the third radiating portion, the fourth radiating portion, and the metal portion, the third radiating portion, the fourth radiating portion, and the metal portion cooperatively resonate at a low frequency band.

10. The antenna structure of claim 7, wherein the primary antenna is a monopole antenna, the secondary antenna is a microstrip line.

11. The antenna structure of claim 7, wherein the third radiating portion surrounds a periphery edge of the second radiating portion.

12. The antenna structure of claim 7, wherein the third radiating portion further comprises a second connecting section and a third connecting section, the second connecting section and the third connecting section are coplanar with the primary antenna; one end of the second connecting section is perpendicularly connected to a distal end of the first connecting section and parallel to the second extending section, another end of the second connecting section is parallel to the first extending section and extends towards the first radiating portion, the third connecting section is connected to a distal end of the second connecting section and parallel to the first extending section.

13. The antenna structure of claim 9, wherein a central frequency of the first high frequency band is about 2500 MHz, a central frequency of the second high frequency band is about 1800 MHz, a central frequency of the third high frequency band is about 2000 MHz, and a central frequency of the low frequency band is about 800 MHz.

* * * * *